US005833436A

United States Patent [19]

Ho

[11] Patent Number: 5,833,436

[45] Date of Patent: Nov. 10, 1998

[54] FAN POSITIONING SLOT STRUCTURE

[76] Inventor: Hsin Chien Ho, 20F-1, 268, Sec.1, Wen-Hua Road, Pan Chiao City, Taipei, Taiwan

[21] Appl. No.: 730,797

[22] Filed: Oct. 17, 1996

[51] Int. Cl.[6] ..... F04D 29/70

[52] U.S. Cl. ..... 416/247 R

[58] Field of Search ..... 416/247 R

[56] References Cited

U.S. PATENT DOCUMENTS 2,620,127 12/1952 Radcliffe ..... 416/247

5,391,056 2/1995 Wang ..... 416/247

*Primary Examiner*—John T. Kwon

*Attorney, Agent, or Firm*—Bacon & Thomas

[57] ABSTRACT

A slot structure for positioning fans in computers, office machines or electrical products. The slot structure includes a positioning slot with an elastic hook members at either side and a plurality of suspended elastic stop blocks at the corners. After the fan is inserted into the positioning slot and hooked by the hook members, the elastic stop blocks will urge upwardly against the fan to eliminate any clearance and secure the fan firmly in place.

4 Claims, 2 Drawing Sheets

FAN POSITIONING SLOT STRUCTURE

BACKGROUND OF THE INVENTION (a) Field of the Invention

The present invention relates to a structure for positioning fans in computers, office machines and electrical products.

(b) Description of the Prior Art

In the design of numerous office appliances and other devices, in order to provide efficiency in production, installation or dismantling, many components are configured to be positioned by hooks. Such a way of positioning is adopted for relatively heavy machines or those demanding excellent positioning. Fans and indicating lights on computer mainframes are typical examples utilizing hooks as positioning members.

Conventional methods of using hooks to secure or position an object generally fall into two types. In one type, the object to be secured (such as that represented by 1 in FIG. 2) itself is provided with fastening hooks 12 for engaging pre-formed holes in a corresponding object, such as a housing. In the other, the housing or casing is provided with hooking members, and the object to be secured or positioned is disposed in a predetermined position or a confined space and is retained and positioned by the hooking members within the confined space.

Of the two methods mentioned above, there is no problem of loosening or improper positioning with the first one, whereas there is the problem that the object, after being placed in the confined space, may not be firmly secured or effectively positioned. The main reason for that is the topmost hooked edge (represented by A in FIG. 2) of the object to be positioned must pass over the topmost end 161 of the hooking member 16 when the object to be positioned is being placed in the confined space. It can therefore be seen that the predetermined distance from the bottommost side of the space to the topmost end of the hooking member 16 is larger than the height H from the bottom end of the object to be positioned to the hooked edge A in order that the object to be positioned may pass over the topmost end 161 of the hooking member 16 to be retained and positioned thereby. As such, after the object to be positioned is hooked and positioned in the space, there will be a clearance, which is also the major cause why the object is not effectively positioned. If the object is not firmly positioned, it will vibrate, displace, buzz or result in poor electrical contact.

SUMMARY OF THE INVENTION

Accordingly, the primary object of the present invention is to provide a positioning mount structure for firmly positioning fans in computers, office machines or electrical products, in which a fan positioning mount is provided with elastic hooks on both sides, which cooperate with elastic pads arranged at the corners of the mount to firmly position the fan with the elastic stop blocks abutting thereagainst so that there is no clearance to allow the fan to displace and the fan may thus be firmly positioned. Besides, the fan positioning mount may be easily mounted in the housing.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
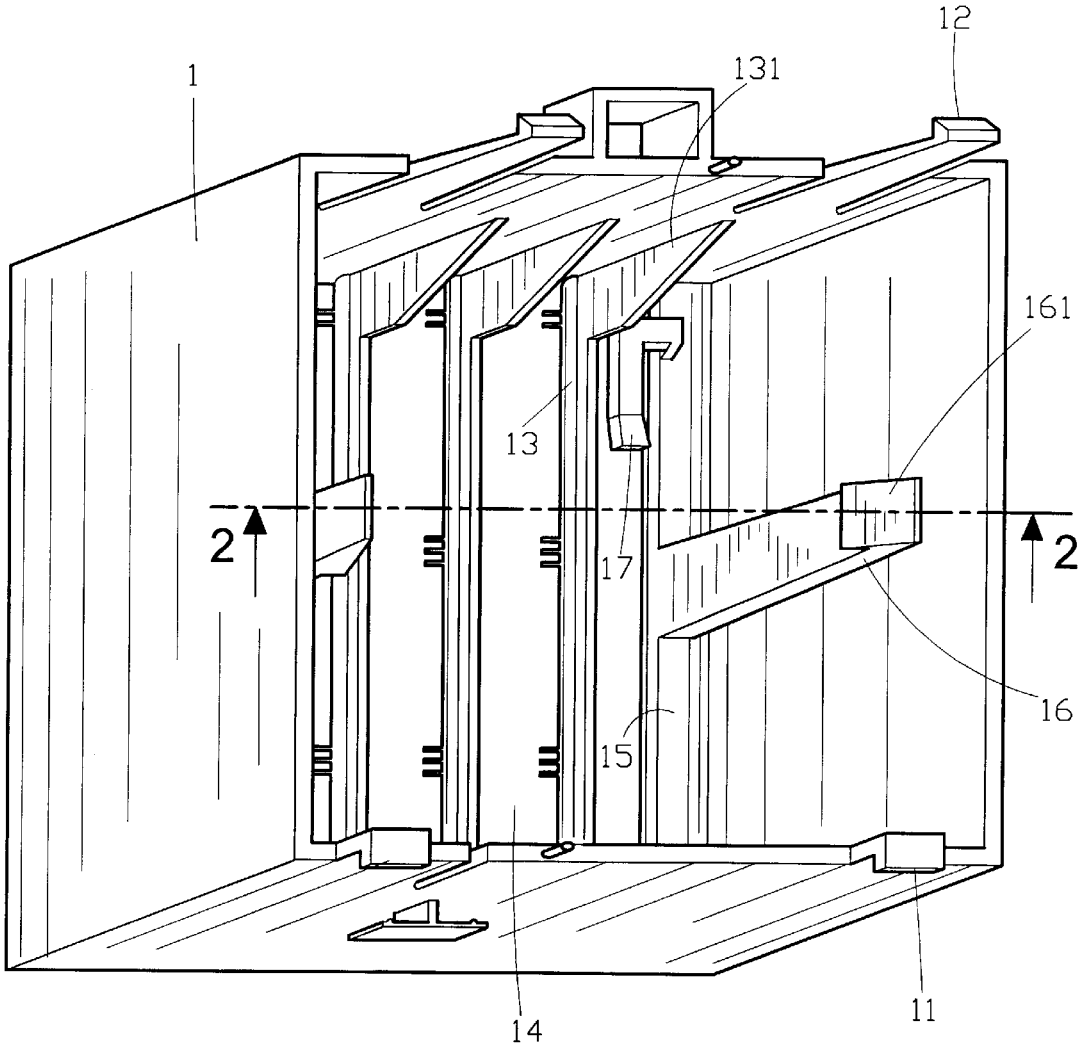
FIG. 1 is an elevational view of the positioning mount according to the present invention.
Figure 2:
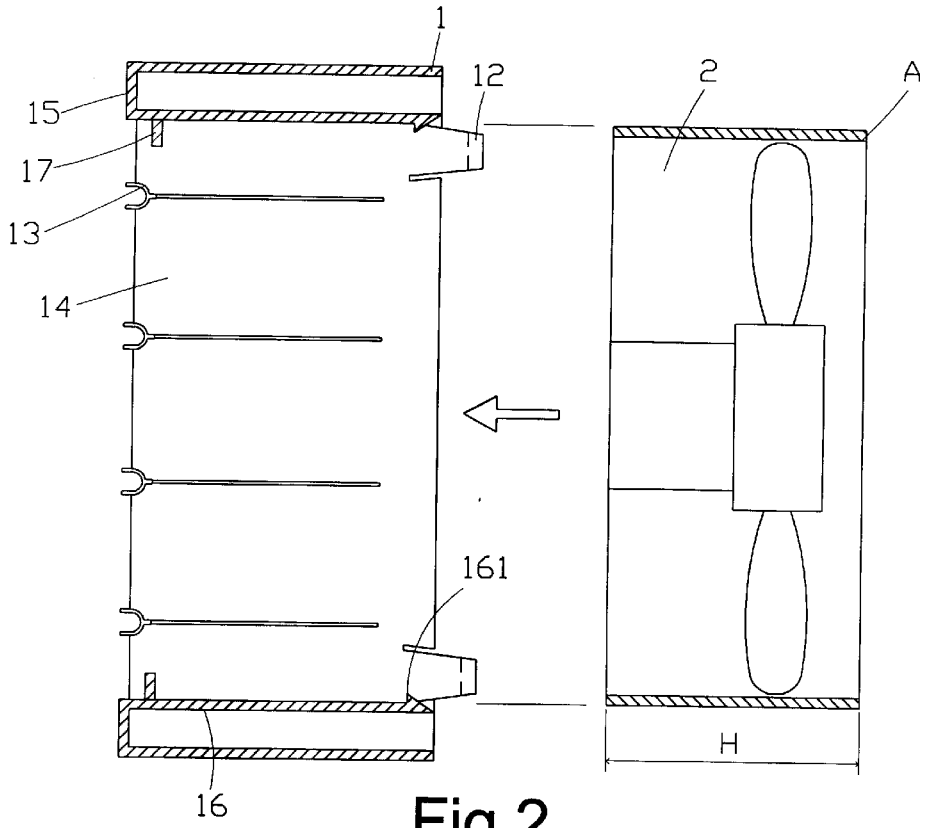
FIG. 2 is an exploded cross-sectional view illustrating the positioning slot prior to mounting of the fan.
Figure 3:
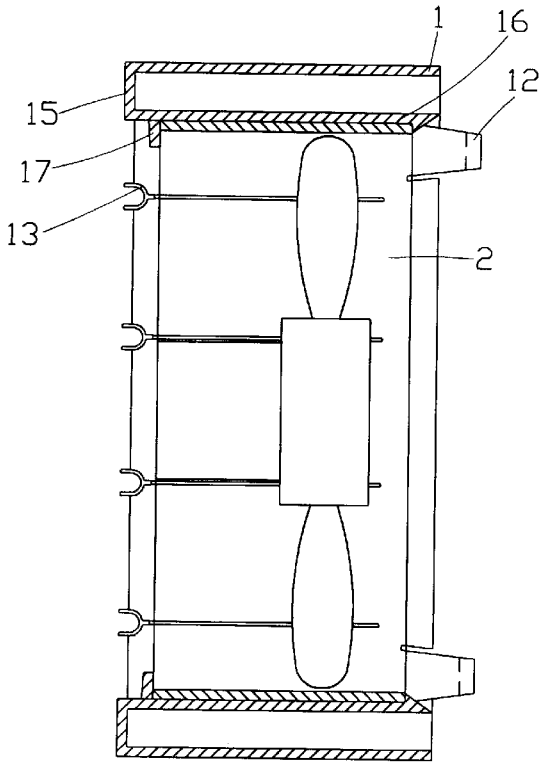
FIG. 3 is an assembled cross-sectional view showing the fan mounted in the positioning mount of the invention.

With reference to FIG. 1, the positioning slot structure according to the present invention essentially comprises a fan positioning 1, which may be a quadrilateral or circular casing. The positioning is provided with at least two positioning posts 11 at one side thereof, and at least two hooks 12 at a corresponding side. The positioning posts 11 and hooks 12 facilitate mounting and positioning of the positioning mount in a housing of a mainframe. The interior of the positioning mount 1 defines a space for accommodating a fan 2. A plurality of baffle plates 13 are provided on a bottom side of the positioning mount 1. A vent path 14 is defined between adjacent baffle plates 13. An upper end of each baffle plate 13 extends upwardly to form an inclined guide plate 131 to facilitate insertion of the fan 2 into the positioning mount 1. On both outermost sides of the row of baffle plates 13 are respectively disposed symmetrical reinforcement plates 15. Each reinforcement plate 15 is provided with an upwardly orienting elastic hook member 16 having a topmost end 161. A plurality of suspended elastic stop blocks 17 are distributed on the edges of the reinforcement plates 15 at the corners of the positioning mount 1. When the fan 2 is inserted into the positioning mount 1, its topmost edge A passes over the topmost end 161 of the hook members 16, compressing the elastic stop blocks 17. After the fan 2 is properly hooked by the hook members 16, the elastic stop blocks 17 will urge upwardly against the fan 2 due to their inertia, as shown in FIG. 3, so that the fan 2 is firmly positioned and prevented from movement. Besides, there is no clearance.

Although the present invention has been illustrated and described with reference to the preferred embodiment thereof, it should be understood that it is in no way limited to the details of such embodiment but is capable of numerous modifications within the scope of the appended claims.

What is claimed is:

1. A device for positioning a fan, comprising: a positioning mount, said positioning mount defining an interior space with an opening for accommodating a fan; a plurality of baffle plates disposed at a bottom side of the positioning mount forming a vent path between every two adjacent baffle plates; a reinforcement plate extending inwardly from two opposite sides of the positioning mount disposed at outermost sides of said baffle plates, each of said reinforcement plates having an elastic hook member having a hook at a distal end, and a plurality of elastic stop blocks disposed on edges of said reinforcement plates such that, when said fan is inserted into said positioning mount, the fan passes over the distal ends of said hook members and compresses said elastic stop blocks whereby said elastic stop blocks urge the fan against said hooks so that said fan is firmly positioned and prevented from displacement.

2. The positioning device of claim 1 wherein the positioning mount has a quadrilateral configuration with a plurality of corners.

3. The positioning device of claim 2 wherein the elastic stop blocks are located adjacent to corners of the positioning mount.

4. The positioning device of claim 1 wherein the positioning mount further comprises at least one positioning post at one side and at least one attaching hook at an opposite side to facilitate attaching the positioning mount to a support.

* * * * *